United States Patent [19]

Asaka et al.

[11] Patent Number: 4,582,469

[45] Date of Patent: Apr. 15, 1986

[54] INTAKE VALVE APPARATUS IN AIR PUMP

[75] Inventors: Urataro Asaka, Kamifukuoka; Yasuhiro Tanaka, Miyazaki, both of Japan

[73] Assignee: Honda Giken Kogyo Kabushiki Kaisha Kabushiki Kaisha Honda Rokku, Japan

[21] Appl. No.: 680,590

[22] Filed: Dec. 11, 1984

Related U.S. Application Data

[63] Continuation of Ser. No. 428,711, Sep. 30, 1982, abandoned.

[30] Foreign Application Priority Data

Nov. 10, 1981 [JP] Japan ..... 56-166541

[51] Int. Cl.[4] ..... F04B 21/02

[52] U.S. Cl. ..... 417/571; 137/855

[58] Field of Search ..... 137/855, 856, 857, 512.4; 417/569, 571, 562, 564

[56] References Cited

U.S. PATENT DOCUMENTS

| | | | |
|---|---|---|---|
| 1,476,794 | 12/1923 | Berry | 417/571 X |
| 2,763,425 | 9/1956 | Sahle | 417/562 X |
| 3,070,122 | 12/1962 | Weatherhead et al. | 417/564 X |
| 3,192,913 | 7/1965 | Rice | 137/855 X |
| 3,314,600 | 4/1967 | Hadley | 137/512.4 |
| 3,679,333 | 7/1972 | Zoppi | 417/571 |
| 3,807,910 | 4/1974 | Paget | 417/564 |

FOREIGN PATENT DOCUMENTS 54-29524 9/1979 Japan .

*Primary Examiner*—Edward K. Look

*Attorney, Agent, or Firm*—Armstrong, Nikaido, Marmelstein & Kubovcik

[57] ABSTRACT

An intake valve apparatus for an air pump having a cylinder with a cylinder liner, a piston positioned within the cylinder liner, a cylinder head and an intake valve. The intake valve comprises an upper annular valve plate having a reed extending inwardly therein and a lower seat plate having an opening facing the reed, the valve plate and seat plate being held between mating surfaces of the cylinder liner and the cylinder head and wherein the reed is positioned for movement in the seat place.

2 Claims, 6 Drawing Figures

INTAKE VALVE APPARATUS IN AIR PUMP

This application is a division of application Ser. No. 428,711, filed Sept. 30, 1982, now abandoned.

BACKGROUND OF THE INVENTION

1. Field of the Invention

This invention relates to an intake valve apparatus used primarily in a high compression ratio type air pump for a motorized two-wheeled vehicle or the like.

2. Description of the Prior Art

A typical prior art air pump is shown in FIGS. 1 and 2, in which a cylinder a has a piston b positioned within a cylinder liner c and is provided thereabove with a cylinder head d and an intake valve means e. Generally with this type of air pump the intake valve means e comprises a metallic plate having a reed valve member $e_1$ which is fixed to the lower surface of the cylinder head d by means of a pin $e_2$ or the like. With this type of arrangement, the intake valve means e projects into the internal air space f in the cylinder a and consequently when the piston b is at its top dead center, the intake valve means e interfers with the piston b. In more detail, when the air pump is a high compression ratio type pump, the air space f between the piston b and the cylinder head d when the piston c is at its top dead center, that is, the air space f constituting the compression air space is comparatively very small or about 0.01–0.3 mm, for instance, and therefore the valve means e lies within this compression air space, but this setting is not always easy.

SUMMARY OF THE INVENTION

It is an object of the preent invention to provide an intake valve for a high compression air pump where the operation of the reed of the valve is not interferred with by the piston when the piston is at top dead center.

According to the present invention, an intake valve means comprises an upper valve plate and the lower seat plate which are held between mutually facing surfaces of a cylinder liner and a cylinder head. The assembling of the valve is simple and easy, and the seat plate serves to protect the reed valve of the valve plate from the top surface of the piston and thereby the reed valve is prevented from being damaged. Additionally the valve plate and the seat plate of the valve means are set in position at the outer circumferential portions thereof by engagement with the cylinder liner through a projection portion on the liner and recess portions on the valve and seat plates, so that the two plates are prevented from slipping out of the position.

DETAILED DESCRIPTION OF THE PREFERRED EMBODIMENT

Figure 1:
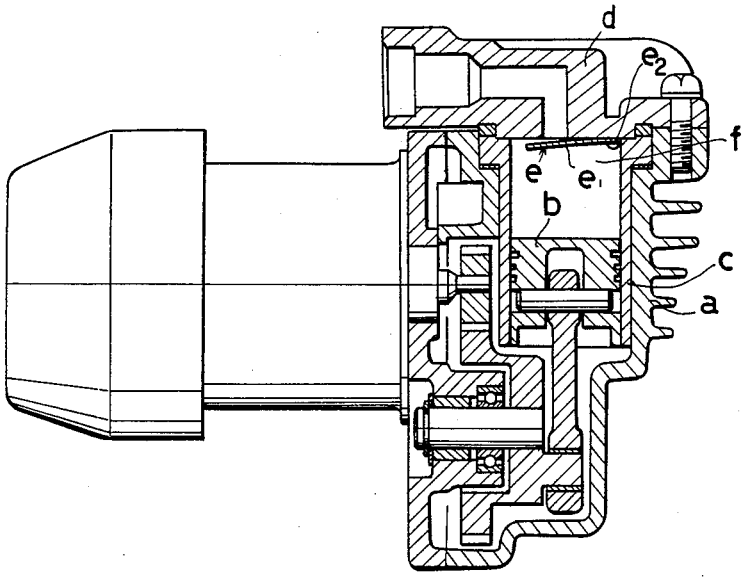
FIG.1 PRIOR ART
FIG. 1 is a side view, partly in section, of an air pump having a conventional valve means.
Figure 2:
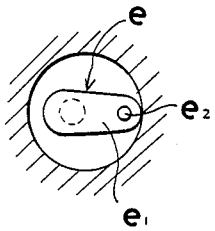
FIG.2 PRIOR ART
FIG. 2 is a bottom plan view taken along the line II—II in FIG. 1.

Referring to FIGS. 3 to 6, a cylinder 1 is the main body of an air pump, and the cylinder comprises a piston 3 positioned within a cylinder liner 2, a cylinder head 4 and an intake valve means 5. The valve means 5 comprises an upper annular valve plate 7 having a reed valve 6 extending inwardly and a lower seat plate 9 having an opening 8 facing the reed valve 6. The valve means 5 is formed by putting the two plates 7 and 9 one upon the other. The valve means 5 is held between mutually facing surfaces of the cylinder 2 and the cylinder head 4, and an outer circumferential portion of the valve means 5 is set in position in relation to the cylinder liner 2 through engagement between a recess portion 10 and a projection portion 11.

The upper surface of the cylinder liner 2 is formed to have a recess surface 2*a* having an L-shaped cross-section and the lower surface of the cylinder head 4 is formed to have a projection surface 4*a*. The mutually facing surfaces of the cylinder liner 2 and the cylinder head 4 are composed of the recess surface 2*a* and the projection surface 4*a*, respectively, and the cylinder liner 2 and the cylinder head 4 are mated at the concave surface 2*a* and the projection surface 4*a*, with an O ring 12 therebetween and are fastened together by screws 13 on the outside portions thereof. The valve plate 7 and the seat plate 9 are mounted in layers in the recess surface 2*a*, and the recess portions 10 and 10 formed in the outer circumferential portions of the two plates 7 and 9 are brought into engagement with the projection portion 11 formed on the inner circumferential surface of the recess surface 2*a*. The reed valve 6 is bent to project into the opening 8 located on the lower side thereof in order to open a valve opening 14 located on the upper side thereof, and the seat plate 9 has a thickness corresponding to the amount of lift of the reed valve 6.

A driving source 15 such as an electric motor or the like is connected to the piston 3 through a gear train 16 and a crank mechanism 17 and a valve 18 is provided as the opening for an outlet valve (not shown).

Figure 3:
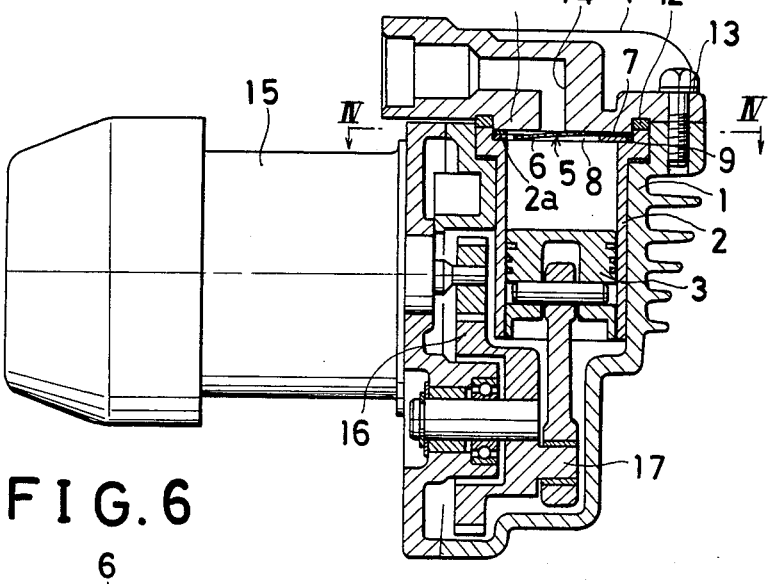
FIG. 3 is a side view, partly in section, of an air pump of the present invention.
Figure 6:
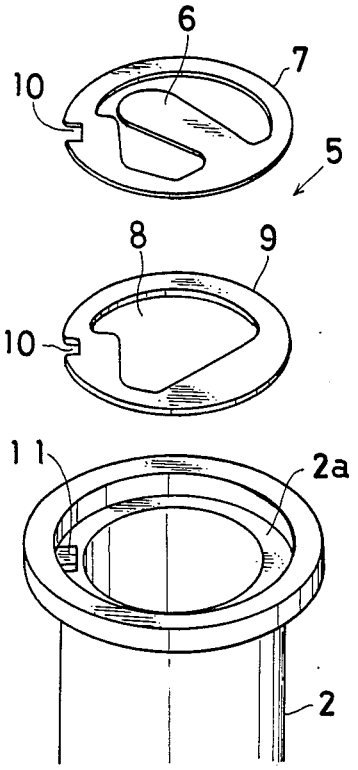
FIG. 6 is an exploded perspective view of an important portion thereof.
Figure 4:
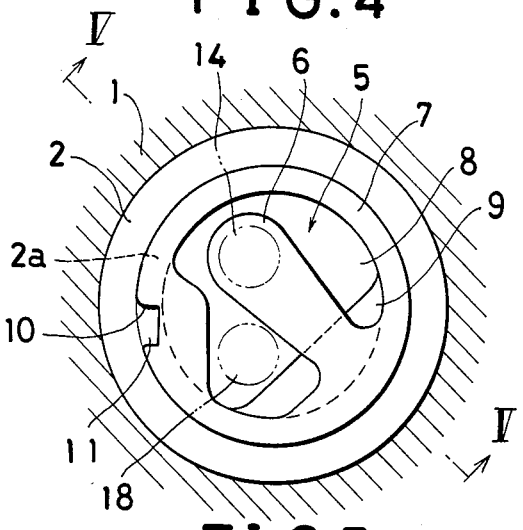
FIG. 4 is a top plan view taken along the line IV—IV in FIG. 3.
Figure 5:
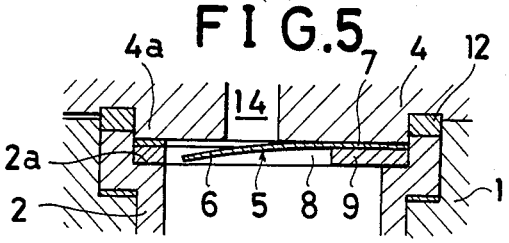
FIG. 5 is a sectional view taken along the line V—V in FIG. 4.

The operation of the apparatus will be explained as follows:

In an ordinary condition, as shown clearly in FIGS. 3 and 5, the reed valve 6 is normally in a downwardly bent condition in which it projects into the through opening 8 located beneath it so the valve opening 14 located above is open. Thus, if the piston 3 is moved downwards, the external air is introduced through the valve into the internal air space above the piston in the cylinder 1. If the piston 3 is then moved upwards, the air in the air space is compressed and the reed valve 6 is pushed upward by the compressed air thereby closing the valve opening 14. The resultant compressed air is discharged to the exterior through the valve opening 18 for the outlet valve (not illustrated), and this action is cyclically repeated. According to this invention, the reed valve 6 is positioned to lie within the opening 8 of the seat plate 9 mounted on the upper surface a of the cylinder liner 2 and there is formed an air space defined by the seat plate 9 interposed between the reed valve 6 and the piston 3. Consequently even when the piston reaches its top dead center and the air space gap is decreased to the compression air space, the piston 2 contacts only the seat plate 9, and thus the seat plate 9 protects the reed valve 6 from the piston 1.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. The combination of an intake valve apparatus and an air pump, said air pump having a cylinder means with a cylinder liner, a piston positioned for reciprocating movement within said cylinder liner, and a cylinder head having an intake port, said intake valve apparatus comprising an upper annular valve plate having an integral reed valve means extending inwardly therein within an annular circumferential portion. thereof, and a lower seat plate having an opening therethrough facing said reed valve means, said reed valve means being supported at a base portion thereof by an inwardly extending underlying supporting portion of said seat plate, movement of a free end of said reed valve means toward said piston and within said opening in said seat plate being limited solely by said underlying supporting portion of said seat plate, said valve plate and said seat plate being held interposed between mating surfaces of said cylinder liner and said cylinder head, said respective mating surfaces being formed of an annular recess in an upper surface of said cylinder liner and a circular projection in a lower surface of said cylinder head extending into said annular recess, said reed valve means being positioned for movement in said opening in said seat plate for opening and closing said intake port, a projection being provided in said annular recess in said cylinder liner, and said lower seat plate and said upper valve plate each having a corresponding recess formed at outer circumferential portions therein for engaging said projection in said annular recess of said cylinder liner thereby preventing rotation of said seat and valve plates relative said cylinder liner and head, aligning said reed valve means in facing relation with said intake port of said cylinder head and aligning said base portion of said reed valve means in overlying relation with said underlying supporting portion of said seat plate.

2. The combination as claimed in claim 1 wherein said seat plate has a thickness corresponding to the amount of movement of said free end of said reed valve means in said opening of said seat plate such that said opening therethrough forms an air space defined by the thickness of said seat plate interposed between said reed valve means and said piston so that contact of said piston with said reed valve means is prevented during movement of said piston and said reed valve means.

* * * * *

UNITED STATES PATENT AND TRADEMARK OFFICE

CERTIFICATE OF CORRECTION

PATENT NO. : 4,582,469

DATED : April 15, 1986

INVENTOR(S) : Urataro ASAKA et al

It is certified that error appears in the above-identified patent and that said Letters Patent is hereby corrected as shown below:

On Title page, Item [73], "Honda Giken Kogyo Kabushiki Kaisha Kabushiki Kaisha Honda Rokku, Japan" should read --Honda Giken Kogyo Kabushiki Kaisha, Tokyo Japan, and Kabushiki Kaisha Honda Rokku, Miyazaki-ken, Japan--.

Signed and Sealed this

Twenty-second Day of June, 1993

*Attest:*

Michael K. Kirk

MICHAEL K. KIRK

*Attesting Officer*

*Acting Commissioner of Patents and Trademarks*